US006705354B2

(12) United States Patent
Yama et al.

(10) Patent No.: US 6,705,354 B2
(45) Date of Patent: Mar. 16, 2004

(54) METHOD OF FORMING TUCK-IN SELVAGE IN CLOTH

(75) Inventors: Kazufumi Yama, Kanazawa (JP); Shigeharu Sawada, Kanazawa (JP)

(73) Assignee: Tsudakoma Kogyo Kabushiki Kaisha, Kanazawa (JP)

( * ) Notice: Subject to any disclaimer, the term of this patent is extended or adjusted under 35 U.S.C. 154(b) by 0 days.

(21) Appl. No.: 10/300,148

(22) Filed: Nov. 20, 2002

(65) Prior Publication Data

US 2003/0106603 A1 Jun. 12, 2003

(30) Foreign Application Priority Data

Nov. 22, 2001 (JP) ..... 2001-358060

(51) Int. Cl.[7] ..... D03D 47/48

(52) U.S. Cl. ..... 139/434; 139/430; 139/435.1; 139/435.2; 139/435.3

(58) Field of Search ..... 139/430, 434, 139/435.1, 435.2, 435.3

(56) References Cited

U.S. PATENT DOCUMENTS 6,231,769 B1 * 5/2001 Pean et al. ..... 210/760
6,240,976 B1 * 6/2001 Satoh et al. ..... 139/434
6,289,942 B1 * 9/2001 Nakada et al. ..... 139/434

* cited by examiner

*Primary Examiner*—John J. Calvert
*Assistant Examiner*—Robert H. Muromoto, Jr.
(74) *Attorney, Agent, or Firm*—Frishauf, Holtz, Goodman & Chick, P.C.

(57) ABSTRACT

After a picking action of a weaving machine, a cloth-end warp maintains its shed over a plurality of weaving cycles including a weaving cycle in which weft ends are tucked in. Air is jetted toward a shed formed by warps in a widthwise direction of weaving from outside the cloth after the weaving cycle in which the weft ends are tucked in, and at latest before the cloth-end warp unsheds. The air jet energizes the weft ends, tucked in, inside the cloth in the widthwise direction of weaving.

5 Claims, 8 Drawing Sheets

METHOD OF FORMING TUCK-IN SELVAGE IN CLOTH

BACKGROUND OF THE INVENTION

1. Technical Filed, to Which the Invention Belongs

The present invention relates to a method of forming a tuck-in selvage in cloth, in which weft ends are folded back into a warp shed.

2. Prior Art

Conventionally, tuck-in devices, in which weft ends are folded back into a warp shed, include tuck-in devices, which are provided on both sides of cloth in a shuttleless loom and in which weft ends cut to a predetermined picking length after picking are temporarily held and then folded back by air jet or the like to be inserted into a warp shed. With the tuck-in devices, a tuck-in selvage method in a shuttleless loom for weaving a pile structure disclosed in, for example, in Japanese Patent Publication No. 2501845 comprises tuck-in of weft ends together in a portion of a pile structure in a weaving cycle subsequent to a weaving cycle of pile formation (cloth is formed). In contrast, tuck-in is performed every weaving cycle in a portion of a non-pile structure. Thereby, it is possible to provide cloth of good selvage clamping in a non-pile structure.

Accordingly, in a non-pile structure, tuck-in is performed every picking, and cloth-end warps interpose therebetween weft ends tucked in and wefts every weaving cycle to intersect each other. However, since a non-pile structure is generally high in density, when tuck-in is performed every weaving cycle, cloth end portions become increasingly high in density, and cloth is enlarged in width. Further, there is caused a problem that pile portions and non-pile portions are made different in width to make attractiveness worse in outward appearance.

The invention has been thought of in view of the above prior art, and has its object to provide a method of forming a tuck-in selvage in cloth, in which no slack is present in selvages on cloth ends, the cloth ends involve no variation in width, and cloth is formed to be good in outward appearance.

SUMMARY OF THE INVENTION

The invention provides a method of forming a tuck-in selvage in cloth, comprising maintaining a shed of a cloth-end warp over a plurality of weaving cycles including a weaving cycle, in which weft ends are tucked in, and jetting an air toward a warp shed in a widthwise direction of weaving from outside the cloth even after that weaving cycle, in which the tuck-in is performed, and at latest before the cloth-end warp unsheds, to energize the weft ends, which are tucked in, inside the cloth in the widthwise direction of weaving.

In addition, the weaving cycle is a cycle from beating to the next beating and composed of a shedding action of warps, picking of wefts, unshedding action of warps, reverse shedding action of warps after unshedding, and the next beating.

Actuation/non-actuation, timing or a jet force of the air jet is selected according to the weaving condition such as cloth structure, weft material, rotational frequency of a weaving machine, or the like.

Also, the invention provides a method of forming a tuck-in selvage in cloth, wherein a tuck-in nozzle for folding weft ends back into a warp shed by means of air jet is used to tuck in the weft ends in the weaving cycle and after the weaving cycle air jet from the tuck-in nozzle energizes the weft ends inside the cloth in the widthwise direction of weaving.

Also, the invention provides a method of forming a tuck-in selvage in cloth, wherein air jet from a tuck-in nozzle for folding weft ends back into a warp shed by means of air jet and air jet from a selvage clamping nozzle for energizing the folded weft ends inside the cloth are used to tuck in weft ends in the weaving cycle, and after the weaving cycle air jet from the selvage clamping nozzle energizes the weft ends inside the cloth in the widthwise direction of weaving.

EMBODIMENTS

Figure 1:
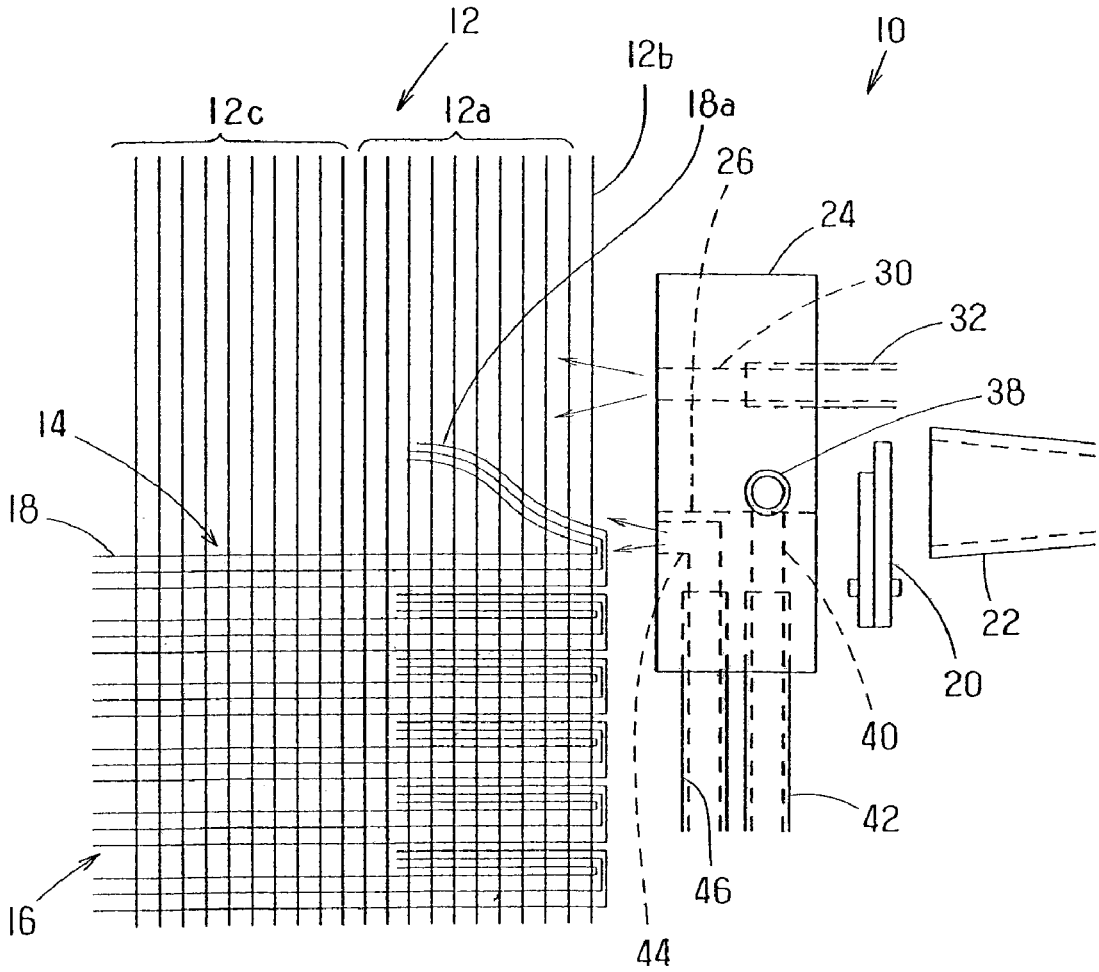
FIG. 1 is a plan view showing a tuck-in device according to a first embodiment of the invention.
Figure 2:
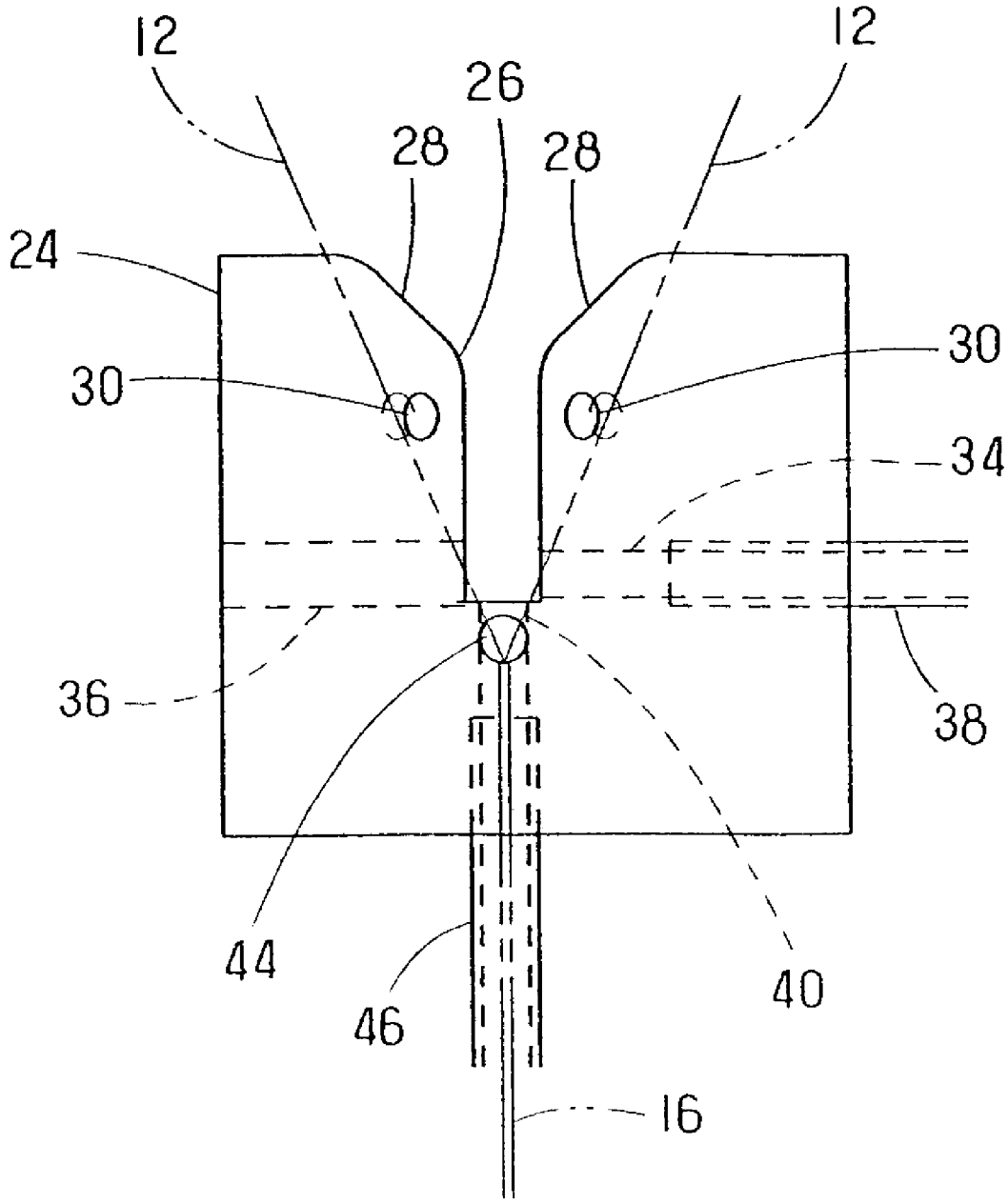
FIG. 2 is a left side view showing a nozzle holder of the tuck-in device according to the first embodiment of the invention.

An explanation will be given below to embodiments of a method of forming a tuck-in selvage in cloth, according to the invention, with reference to the drawings. FIGS. 1 to 10 show a tuck-in device 10 according to a first embodiment of the invention. A pair of tuck-in devices 10 are provided in left-right symmetry on both sides of cloth 16 formed with a shed of warps 12 as woven. Provided outside one of the pair of tuck-in devices 10 is a main nozzle for picking (not shown), and provided outside the other of the pair of tuck-in devices is a suction nozzle 22 for sucking and holding a tip end of weft 18 as picked. Also, cutters 20 for weft cutting, respectively, are provided between the tuck-in devices 10 and the suction nozzle 22 or the main nozzle for picking. The fundamental construction of the pair of tuck-in devices 10 is symmetrical, and so the construction of the tuck-in device 10 on a side of the suction nozzle 22 will be described here.

The tuck-in device 10 is provided with a block-shaped nozzle holder 24, which is disposed near a cloth fell 14 with both sides thereof in parallel to the warps 12. Formed on the nozzle holder 24 is a slit-shaped weft-end guide groove 26, which is opened at a delivery side, cloth side, and a side toward the cutter 20 and extends near the cloth fell 14 from an end on the delivery side. Formed on upper and lower edges of the weft-end guide groove 26 on the delivery side are vertically tapered, divergent guide surfaces 28, respectively, to surely conduct a weft end 18*a* to the weft-end guide groove 26.

A pair of tuck-in nozzles 30 are embedded in the nozzle holder 24 to extend from a side of the cutter 20 to be opened at the cloth side. The pair of tuck-in nozzles 30 are provided above and below the weft-end guide groove 26, an axis of a jet flow from the upwardly positioned tuck-in nozzle 30 being directed to intersect a warp line upwardly obliquely, and an axis of a jet flow from the downwardly positioned tuck-in nozzle 30 being directed to intersect a warp line downwardly obliquely. The respective tuck-in nozzles 30, respectively, are connected to a pair of air feed pipes 32.

A jet port of a weft-end gripping nozzle 34 is opened to an upper side surface of a pair of mutually opposed inner surfaces of the weft-end guide groove 26 of the nozzle holder 24. Provided on a lower side surface of the weft-end guide groove 26 is a weft-end gripping hole 36 formed facing the weft-end gripping nozzle 34 and being a though hole extending perpendicular to a lower surface of the nozzle holder 24. An axis of the weft-end gripping nozzle 34 aligns with an axis of the weft-end gripping hole 36. The weft-end gripping nozzle 34 is connected to an air feed pipe 38.

Provided on a take-up side of the nozzle holder 24 is a weft-end release nozzle 40 to be opened to an inner wall portion of the weft-end guide groove 26. An axis of a jet flow from the weft-end release nozzle 40 is directed toward an opening portion of the weft-end guide groove 26. The weft-end release nozzle 40 is connected to an air feed pipe 42.

Further, embedded in a take-side of the nozzle holder 24 is a selvage clamping nozzle 44 to be opened near the cloth fell 14 on a side surface of the cloth. An axis of a jet flow from the selvage clamping nozzle 44 aligns with a widthwise direction of weaving. The selvage clamping nozzle 44 is connected to an air feed pipe 46.

Figure 3:
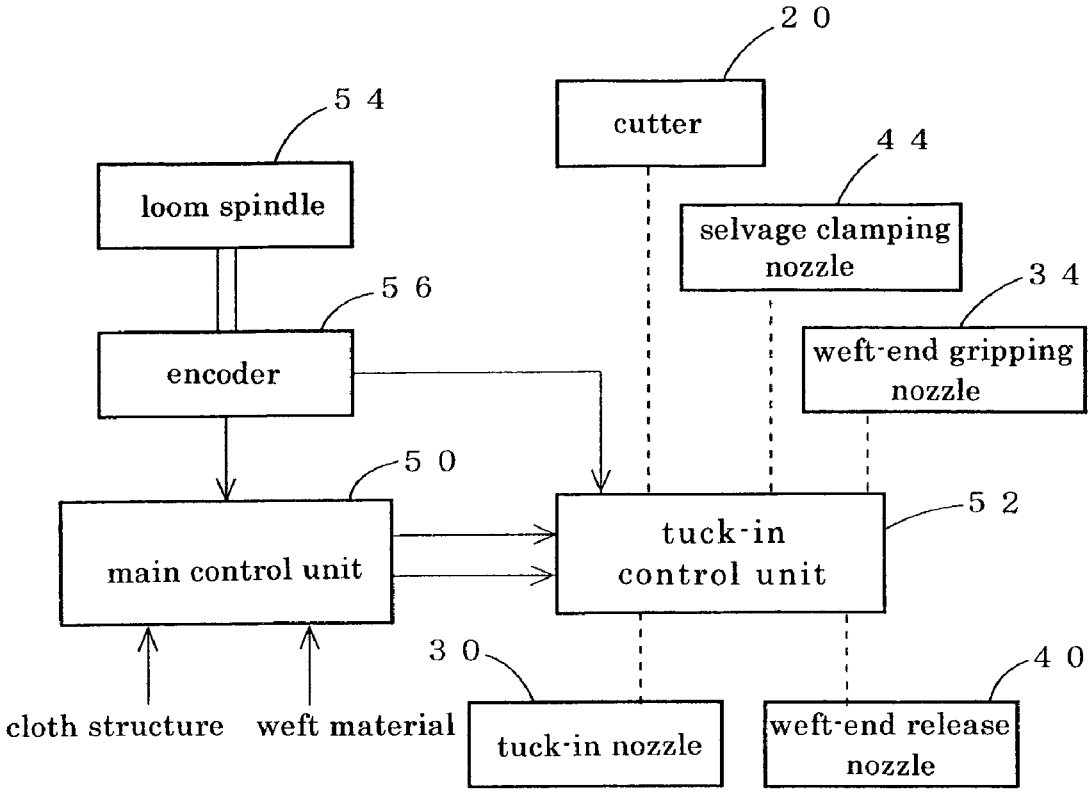
FIG. 3 is a block diagram of a control system of the tuck-in device according to the first embodiment of the invention.

The respective air pipes 32, 38, 42, 46 are connected to a pressure air source, which includes a regulator or the like, via change-over valves of electromagnetic drive type. The respective change-over valves are connected to a tuck-in control unit 52, which operates according to a predetermined program stored in a main control unit 50, as shown in FIG. 3 to be electromagnetically driven thereby. Also, input into the main control unit 50 are a loom rotating angle signal from an encoder 56 connected to a loom spindle 54, and a cloth structure information and a weft material information from a weft selection device, dobby control device or the like, the main control unit issuing a predetermined command to the tuck-in control unit 52.

Subsequently, an explanation will be given to the operation of the tuck-in device 10. With the embodiment, the warps 12 are composed of a cloth-end warp 12*b* disposed on an outermost side of the cloth 16, selvage warps 12*a* disposed inside, and ground warps (ordinary warps) 12*c* disposed further inside, the respective warps 12*a*, 12*b*, 12*c* performing shedding movements independently. The embodiment is related to the weaving action of a non-pile structure of a pile cloth, and after twelve wefts are picked in the same shedding state of the selvage wares 12*a*, they unshed, and further twelve selvage warps are likewise picked in the reverse shedding state, the above procedure being repeated. Also, the cloth-end warp 12*b* performs a tuck-in motion, in which a warp shed is closed every picking of three wefts to form a reverse shed and three weft ends 18*a* as picked are inserted together into the reverse shed, the above procedure being repeated.

Figure 10:
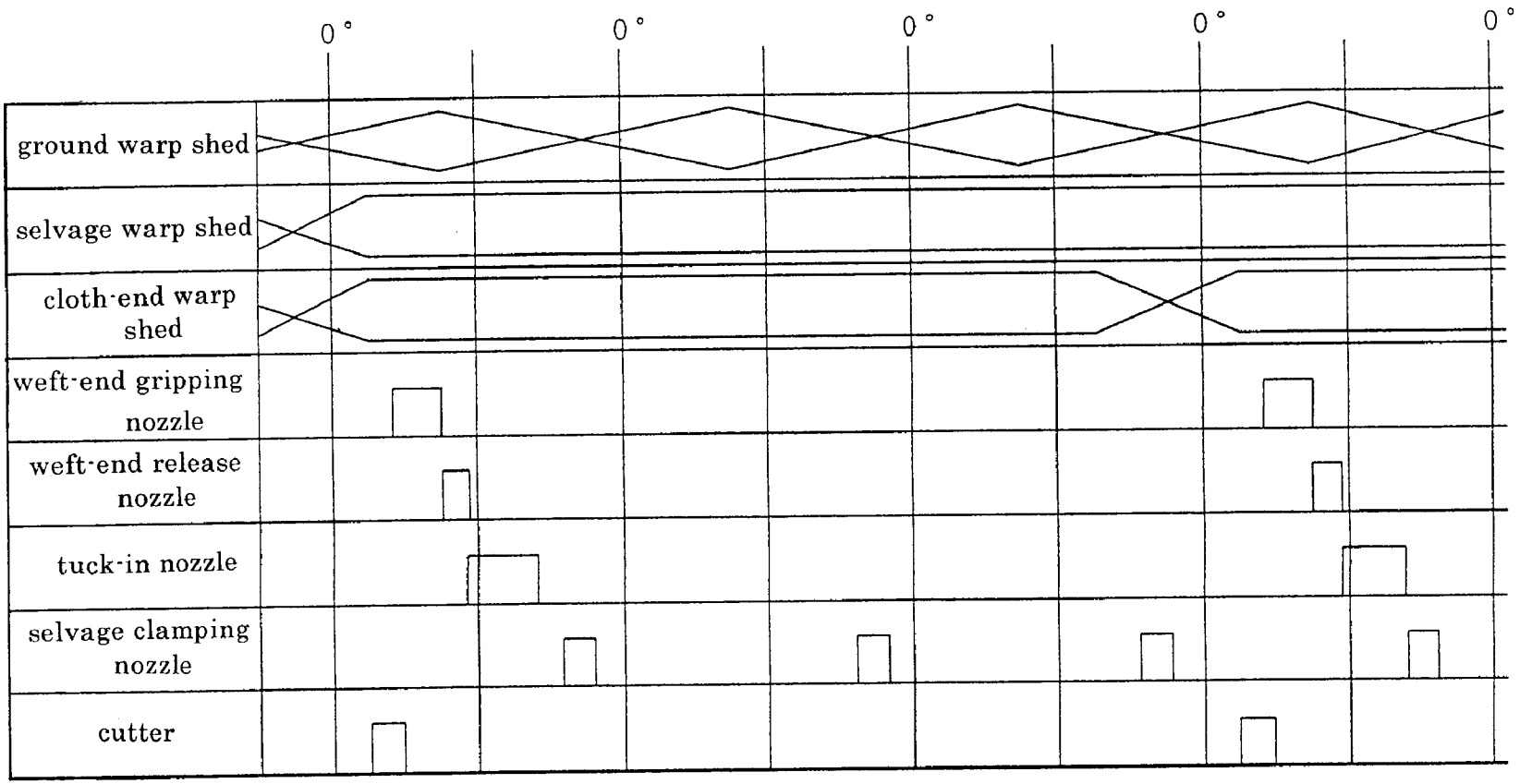
FIG. 10 is a timing chart showing the operation of the tuck-in device according to the first embodiment of the invention.

First, after picking, in a state, in which all the respective warps 12 are unshed to form a shed in a reverse phase, advancement of a reed (not shown) causes an end of a weft 18 to enter into the weft-end guide groove 26 of the nozzle holder 24. At this time, the tip end of the weft 18 is caught by the suction nozzle 22. After beating, as shown in FIG. 10, at a point of time when the reed retreats a little, the cutter 20 cuts the three wefts 18 having been picked previously three times. At the time of this cutting, the weft-end gripping nozzle 34 is opened to jet an air flow toward the weft-end gripping hole 36 from the weft-end gripping nozzle 34. The weft end 18*a* as cut is pulled by the air flow from the weft-end gripping nozzle 34 to be temporarily moored by the weft-end gripping hole 36.

When the reed further retreats, the next picking is performed in a predetermined timing. Also, the weft-end gripping nozzle 34 is closed and the weft-end release nozzle 40 is opened to cause its air jet flow to pull out the weft end 18*a* from the weft-end gripping hole 36. Thereafter, the tuck-in nozzles 30 are opened, so that air jet flows from the tuck-in nozzles 30 cause three weft ends 18*a* cut by the cutter 20 to blow into a shed formed by the warps 12 together. Thereafter, the tuck-in nozzles 30 are opened and the ground warps 12*c* unshed to form a reverse shed, thus permitting the reed to advance for beating. In this embodiment, after the tuck-in nozzles 30 are closed and before the ground warps 12*c* unshed, the selvage clamping nozzle 44 is opened to jet an air into a shed of the warps from outside of the cloth in a widthwise direction of weaving. The three weft ends 18*a* inserted into the shed of the warps are energized by this air jet flow inside the cloth in the widthwise direction of weaving, and so tuck-in of the three weft ends 18*a* is terminated.

Figure 4:
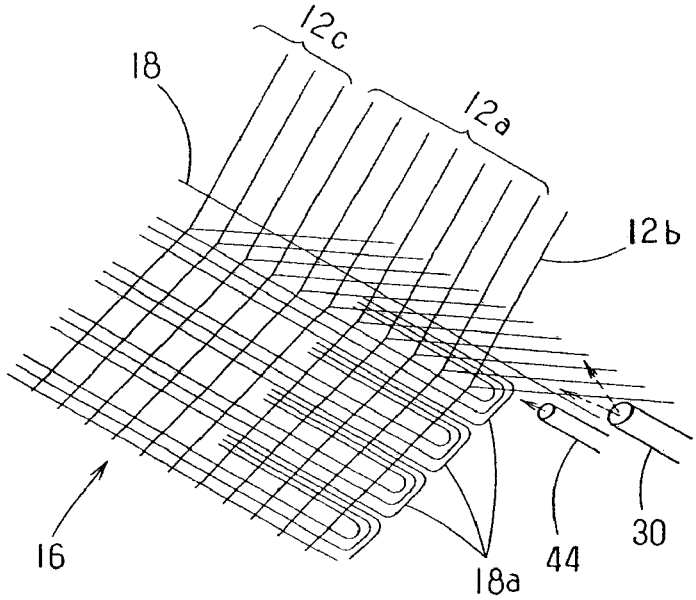
FIG. 4 is a perspective view showing the operation of the tuck-in device according to the first embodiment of the invention.

(State in FIG. 4)

Figure 5:
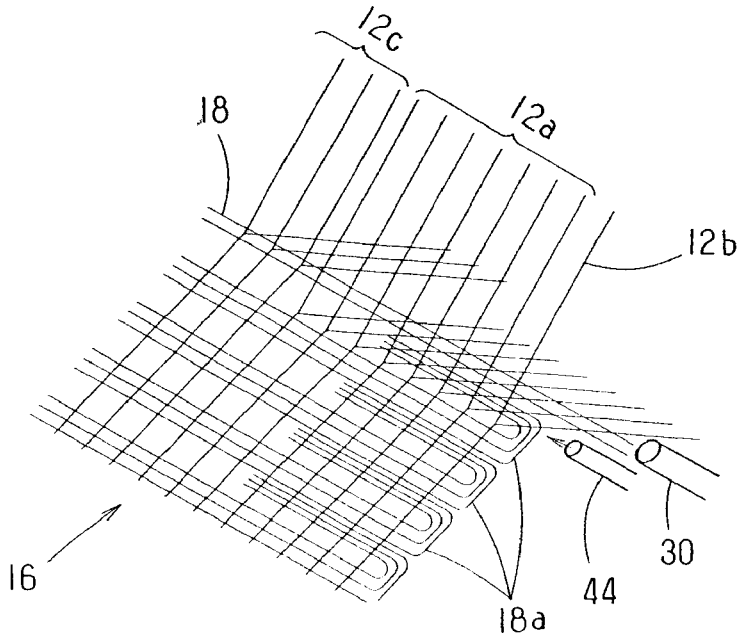
FIG. 5 is a perspective view showing the operation of the tuck-in device according to the first embodiment of the invention.
Figure 6:
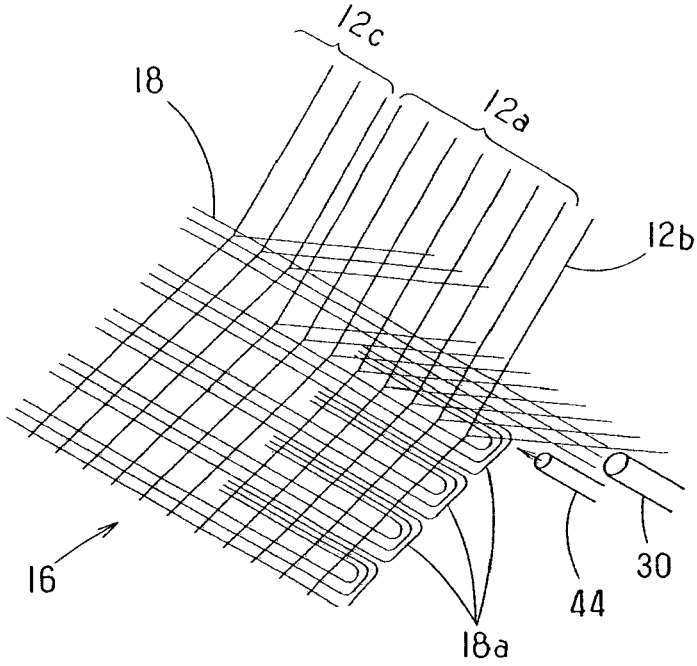
FIG. 6 is a perspective view showing the operation of the tuck-in device according to the first embodiment of the invention.
Figure 7:
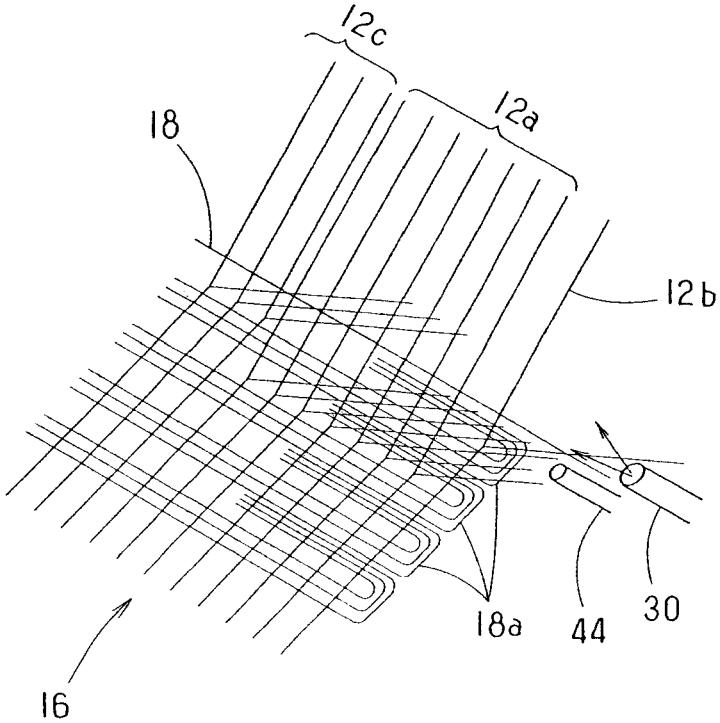
FIG. 7 is a perspective view showing the operation of the tuck-in device according to the first embodiment of the invention.
Figure 8:
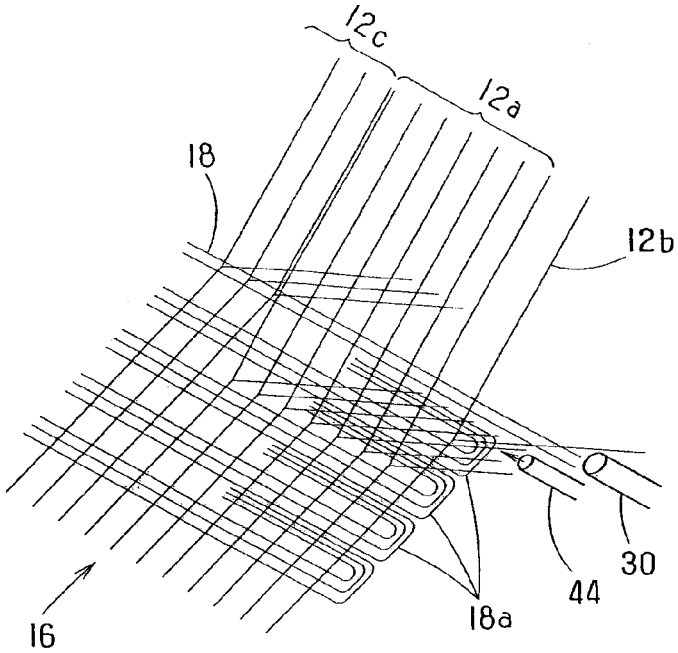
FIG. 8 is a perspective view showing the operation of the tuck-in device according to the first embodiment of the invention.
Figure 9:
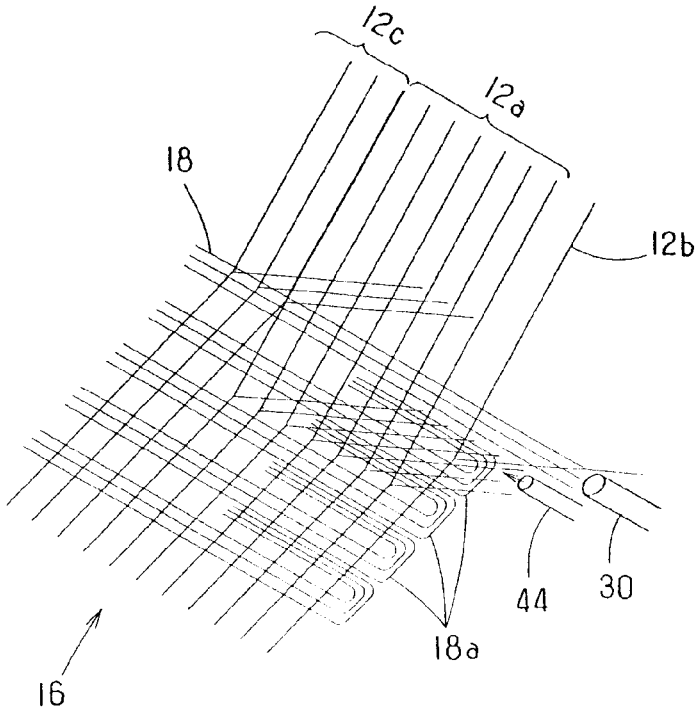
FIG. 9 is a perspective view showing the operation of the tuck-in device according to the first embodiment of the invention.

Further, the next and the next thereafter picking are performed and before the ground warps 12*c* are put into an unshed state, only the selvage clamping nozzle 44 jets an air toward a shed of the warps 12 for a predetermined period of time to cause the three weft ends 18*a* having undergone tuck-in to be energized into the shed of the warps 12 inside the cloth in the widthwise direction of weaving, thereby preventing slack in the weft ends 18*a* having undergone tuck-in (states shown in FIGS. 5 and 6).

When picking of the three wefts is terminated after all the warps 12 are unshed to form a reverse shed (a state shown in FIG. 6), the cloth-end warp 12*b* unsheds to form a reverse shed. Thereafter, the three wefts picked are cut by the cutter 20, and the weft-end gripping nozzle 34, the weft-end release nozzle 40, the tuck-in nozzles 30, and the selvage clamping nozzle 44 sequentially jet an air to perform tuck-in actions (a state shown in FIG. 7).

Picking and tuck-in actions are again performed in the same manner as described above. Here, as shown in FIGS. 7 to 9 and 10, the selvage warps 12*a* are maintained in a shed state while the cloth-end warp 12*b* unsheds after picking of three wefts and thereafter picking is performed. Then a warp shed is reversed every picking of twelve wefts.

Here, actuation and non-actuation of air jet performed by the selvage clamping nozzle 44 after the weaving cycle, in which tuck-in is performed, are selected and performed according to the weaving condition such as cloth structure, weft material, rotational frequency of a weaving machine, or the like. For example, during weaving of a structure, in which weft ends 18*a* tucked in involve no conspicuous slack, the selvage clamping nozzle 44 is not actuated except jetting at the time of tuck-in motion, thus suppressing consumption of air. Also, in the case of tuck-in of a weft material hard to slack (poor stretch, weak twisting, or the like), the selvage clamping nozzle 44 is not actuated except jetting at the time of tuck-in motion, thus enabling suppressing consumption of air. Also, when rotational frequency of a weaving machine is high, the cloth-end warp 12*b* reversely sheds in some cases before weft ends 18*a* having undergone tuck-in slack, thereby preventing slack and enabling the selvage clamping nozzle not to be actuated.

Also, timing and jet force of an air jet made by the selvage clamping nozzle 44 are appropriately adjusted according to the weaving condition such as cloth structure, weft material, rotational frequency of a weaving machine, or the like. For example, during weaving of a structure, in which weft ends 18*a* being tucked in involve no conspicuous slack, the selvage clamping nozzle 44 may be delayed in the start of jetting and termination of jetting may be put forward, or jet force may be weakened. Thereby, an injection period is shortened and air pressure is lowered to enable suppressing air consumption. Also, in the case of tuck-in of a weft material hard to slack (poor stretch, weak twisting, or the like), the selvage clamping nozzle 44 may be delayed in the start of jetting and termination of jetting may be put forward, or jet force may be weakened. In this case, it is possible to suppress air consumption. Likewise, in the case where rotational frequency of a weaving machine is high, it is possible in some cases to shorten an injection period and weaken the jet force.

With the tuck-in selvage forming method according to the embodiment, even when the cloth-end warp 12*b* is put in a reverse shed state every picking of three wefts, an air flow is jetted from the selvage clamping nozzle 44 before unshedding of the ground warps 12*c* to surely prevent weft ends 18*a* tucked in in the meantime from springing from the cloth end in a loop-like manner to slack. Also, even if the weft ends 18*a* slack in a warp shed, the air flow from the selvage clamping nozzle 44 causes the weft ends 18*a* to blow off inside the cloth 16 in the warp shed, thus eliminating such slack.

Accordingly, no loop-shaped weft ends project from an edge portion of the cloth 16 to form a tuck-in selvage of good attractiveness free of slack in the weft ends 18*a*. Further, comparing with a tuck-in selvage forming method, in which weft ends 18*a* are tucked in every picking and a cloth-end warp 12*b* and the weft ends 18*a* cross each other every picking to become high in density, a cloth end is suppressed in becoming high in density and a favorable tuck-in selvage is formed. In particular, even in the case where a plurality of weft ends 18*a* in a pile structure undergo tuck-in together in a pile cloth, the tuck-in selvage forming method according to the embodiment is applied to a non-pile structure, which is generally formed in high density, high density in a cloth end of the non-pile structure is suppressed and any difference in cloth width is eliminated between a pile structure and a non-pile structure, thus enabling obtaining a cloth of good attractiveness.

Figure 11:
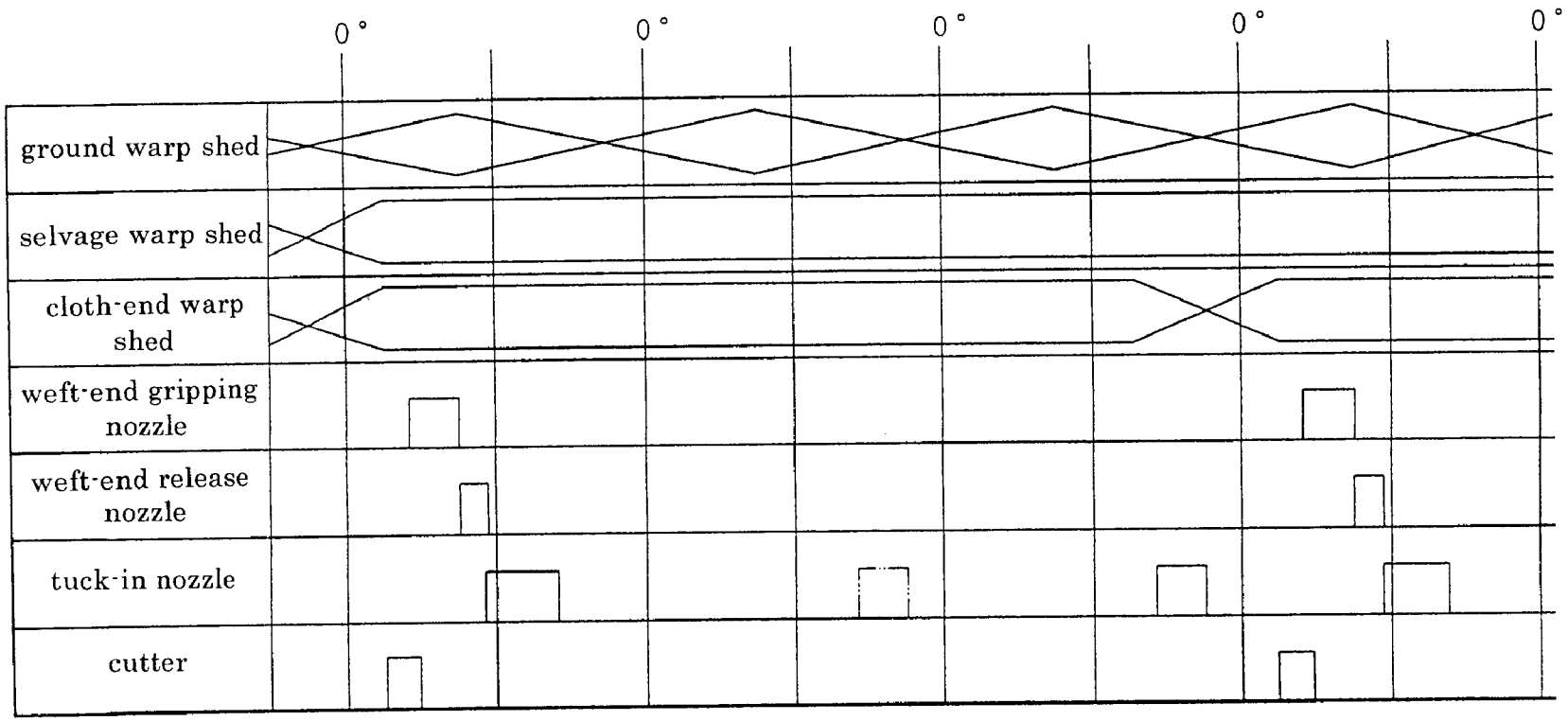
FIG. 11 is a timing chart showing the operation of a tuck-in device according to a second embodiment of the invention.

Subsequently, an explanation will be given to a second embodiment of the invention with reference to FIG. 11. In a method of forming a tuck-in selvage in cloth, according to the embodiment, any selvage clamping nozzle is not used and the jet terminating timing of a tuck-in nozzle at the time of tuck-in of weft ends is made slower than the above embodiment. Further, after picking of three wefts, air is jetted from a tuck-in nozzle before cloth end warps are unshed whereby weft ends tucked in are prevented from slacking. In this case, like the above embodiment, the air may be jetted from the tuck-in nozzle before ground warps, respectively, unshed (alternate long and two short dashes line in FIG. 11). Thereby, it is possible to further surely prevent weft ends from slacking.

According to the method of forming a tuck-in selvage in cloth, according to the embodiment, without the use of any selvage clamping nozzle, only modification of a way to control a tuck-in nozzle makes it possible to simply prevent slack of weft ends tucked in.

The method of forming a tuck-in selvage in cloth, according to the invention, is not limited to the above embodiment irrespective of the number of warps in picking performed in a shed maintained by a cloth end warp and a way of tuck-in. For example, with a pile structure, an irregular tuck-in method is in some cases adopted, in which in order to effect tuck-in of three weft ends, two weft ends are tucked in together and then one weft end is tucked in. In this case, a selvage clamping nozzle or the like jets an air in a weaving cycle of the second picking in a shed formed by warps at the same cloth end after a weaving cycle of tuck-in of a single weft.

Also, with a tuck-in device, the method of forming a tuck-in selvage in cloth, according to the invention, may be applied to a needle type device as well as an air jet type one. Further, the method may be used in formation of a tuck-in selvage in other cloth than a pile cloth composed of a pile structure and a non-pile structure.

In the method of forming a tuck-in selvage in cloth, according to the invention, a shed formed by a cloth end warp is maintained over a plurality of weaving cycles including a weaving cycle, in which a weft end is tucked in, and an air is jetted after the weaving cycles and before the cloth end warp unsheds, whereby the weft end tucked in is blown inside the cloth in a widthwise direction of weaving to eliminate slack. Thereby, intersection of the weft end and the cloth end warp is decreased to enable suppressing the cloth end becoming high in density and avoiding variation of cloth width depending upon a cloth structure. Also, since the weft end tucked in is extended inside the cloth to eliminate slack, the weft end neither projects from the cloth end in a loop-like manner nor makes any slack tuck-in selvage, so that it is possible to form a cloth including a favorable tuck-in of good attractiveness.

Also, actuation, timing and a jet force of air jet into a shed formed by a cloth end warp are appropriately adjusted according to the weaving condition such as cloth structure, weft material, rotational frequency of a weaving machine, or the like whereby it is possible to suppress consumption of a jet air without failure in quality of cloth.

According to the invention, in the case where tuck-in is performed by air jet from a tuck-in nozzle, the tuck-in nozzle may jet an air onto a weft end before a cloth end warp unsheds even after the above weaving cycle, which makes it possible to simplify the construction of the device.

Also, in the case where tuck-in is performed by air jet from a selvage clamping nozzle together with air jet from a tuck-in nozzle, the selvage clamping nozzle may jet an air onto a weft end before a cloth end warp unsheds even after the above weaving cycle, and thus the selvage clamping nozzle mounted in an optimum position is used to enable suppressing an amount of air jet and efficiently preventing slack in a weft end.

What is claimed is:

1. A method of forming a tuck-in selvage in cloth in a shuttleless loom, wherein weft ends having been picked are tucked in by performed the following steps (a) to (c):

(a) maintaining a shed of a cloth-end warp over a plurality of weaving cycles during which a plurality of wefts are picked, including a weaving cycle in which weft ends are tucked in;

(b) making a tuck-in motion, in which the cloth-end warp unsheds after maintaining the shed over the plurality of weaving cycles and sheds again, so that the plurality of weft ends having been picked in a warp shed formed before the unshedding of the cloth-end warp are inserted together into a next warp shed formed after the unshedding, subsequently performing picking in the warp shed at least once in at least one of the weaving cycles and a tuck-in motion after the unshedding of the cloth-end warp, and thereafter repeating the step (b); and (c) during a time the shed of the cloth-end warp is maintained and during the plurality of weaving cycles including the weaving cycle in which the weft ends are tucked in, jetting air toward the warp shed from outside the cloth after the tuck-in motion, and at latest before the cloth-end warp unsheds, thereby causing an air flow to push the weft ends, which have been tucked in, inside the cloth in a widthwise direction of weaving.

2. The method of forming a tuck-in selvage in cloth, according to claim 1, wherein a tuck-in nozzle for folding weft ends back into a warp shed by means of an air jet is used to tuck in the weft ends during the weaving cycle in which the weft ends are tucked in; and wherein after the weaving cycle in which the weft ends are tucked in, air is jetted from the tuck-in nozzle, thereby causing an airflow to push the weft ends, which have been tucked in, inside the cloth in a widthwise direction of weaving.

3. The method of forming a tuck-in selvage in cloth, according to claim 1, wherein air jetted from a tuck-in nozzle for folding weft ends back into a warp shed by means of an air jet and air jetted from a selvage clamping nozzle for pushing the folded weft ends inside the cloth are used to tuck in weft ends during the weaving cycle in which the weft ends are tucked in, and wherein after the weaving cycle in which the weft ends are tucked in, air is jetted from the selvage clamping nozzle, thereby causing an airflow to push the weft ends, which have been tucked in, inside the cloth in a widthwise direction of weaving.

4. The method of forming a tuck-in selvage in cloth, according to claim 1, wherein actuation and non-actuation of the jetting air is selectively made according to weaving conditions.

5. The method of forming a tuck-in selvage in cloth, according to claim 1, wherein timing and a jet force of the jetting air is adjusted according to weaving conditions.

* * * * *